US008246699B2

(12) United States Patent
May et al.

(10) Patent No.: US 8,246,699 B2
(45) Date of Patent: Aug. 21, 2012

(54) PALM DIESEL WITH LOW POUR POINT FOR COLD CLIMATE COUNTRIES

(75) Inventors: Choo Yuen May, Selangor (MY); Cheng Sit Foon, Selangor (MY); Yung Chee Liang, Selangor (MY); Harrison Lau Nik Nang, Selangor (MY); Ma Ah Ngan, Selangor (MY); Yusof Basiron, Selangor (MY)

(73) Assignee: Malaysian Palm Oil Board, Kajang, Selangor (MY)

( * ) Notice: Subject to any disclaimer, the term of this patent is extended or adjusted under 35 U.S.C. 154(b) by 558 days.

(21) Appl. No.: 12/426,761

(22) Filed: Apr. 20, 2009

(65) Prior Publication Data

US 2009/0199463 A1 Aug. 13, 2009

Related U.S. Application Data

(63) Continuation of application No. 10/465,847, filed on Jun. 20, 2003, now abandoned, which is a continuation-in-part of application No. 10/440,169, filed on May 19, 2003, now abandoned.

(51) Int. Cl.
*C10L 1/18* (2006.01)

(52) U.S. Cl. ..... 44/388; 44/308; 554/167; 554/174; 554/175; 554/206; 554/208

(58) Field of Classification Search ..... 44/308, 44/388; 554/167, 174, 175, 206, 208
See application file for complete search history.

(56) References Cited

U.S. PATENT DOCUMENTS

| | | | | |
|---|---|---|---|---|
| 2,383,632 | A * | 8/1945 | Trent | 554/167 |
| 2,543,055 | A * | 2/1951 | Pool et al. | 554/174 |
| 4,004,041 | A | 1/1977 | Koslowsky | |
| 4,364,743 | A | 12/1982 | Erner | |
| 4,695,411 | A | 9/1987 | Stern et al. | |
| 5,233,109 | A | 8/1993 | Chow | |
| 5,399,731 | A | 3/1995 | Wimmer | |
| 6,051,538 | A | 4/2000 | Majerczak | |

* cited by examiner

*Primary Examiner* — Cephia D Toomer
(74) *Attorney, Agent, or Firm* — Birch, Stewart, Kolasch & Birch, LLP

(57) ABSTRACT

The processes of producing the low pour point palm diesel particularly but not exclusively via esterification of C18, C18:1 and C18:2 mixed fatty acids with methanol or ethanol, or fractional distillation of methyl or ethyl esters of palm oil, palm kernel oil and palm oil products, or fractional distillation of methyl or ethyl esters of palm oil, palm kernel oil and palm oil products, followed by crystallization, or crystallization of methyl or ethyl esters of palm oil, palm kernel oil and palm oil products, or crystallization of methyl or ethyl esters of palm oil, palm kernel oil and palm oil products, followed by fractional distillation.

7 Claims, No Drawings

PALM DIESEL WITH LOW POUR POINT FOR COLD CLIMATE COUNTRIES

CROSS REFERENCE TO RELATED APPLICATIONS

This is a Continuation of application Ser. No. 10/465,847 filed on Jun. 20, 2003 now abandoned, which is a Continuation-in-Part of application Ser. No. 10/440,169 filed on May 19, 2003, which has been allowed to go abandoned, the contents of all of which are incorporated herein by reference.

FIELD OF INVENTION

The present invention relates to a biofuel with improved cold temperature flow characteristics without any additives. More particularly but not exclusively, it relates to an improved biofuel as a substitute for petroleum diesel from palm oil, palm kernel oil, palm oil products and palm kernel oil products.

BACKGROUND ART

Due to increased environmental consciousness, the concept of using vegetable oil as a fuel has developed in recent years. In Malaysia, biodiesel has been successfully derived from palm oil. Patent No. PJ1105/88 has revealed a process of producing palm oil methyl esters (palm diesel) from palm oil. Palm oil is converted into palm oil methyl esters via transesterification and the derived palm oil methyl esters or palm diesel have proven to exhibit good fuel properties and are able to be used as a diesel substitute. 'Production and Evaluation of Palm Oil Methyl Esters as Diesel Substitute' published in Elaeis Special Issue, November 1995, pp 15-25 discloses the fuel characteristics of palm diesel and also its potential to be used as a diesel substitute.

However, palm oil methyl esters being evaluated of having pour point of +15° C. to +18° C. has a limitation to its usage or consumption as a fuel especially in cold climate countries. Although palm diesel exhibits good fuel properties and able to meet the fuel specifications, some problems arise when it is used in low operational temperature. This is because the pour point of palm oil methyl esters is +15° C. to +18° C. Pour point is the temperature of the oil 3° C. above the point at which the test sample will not move when tipped out of the horizontal.

The fluidity of a fuel in an engine or machine is very important under all circumstances. When starting up an engine from cold, it is vital that the mechanical parts are able to move freely and there is no difficulty in transporting the fuel through lines and pumps. Failure to do so will lead to blockage and the engine or machine may become inefficient and inoperable.

When fuel is cooled to low temperature, it can undergo a number of changes, namely solidification, solidification with the formation of a precipitate of macrocrystals and solidification with the formation of microcrystals, which swell, giving a crystalline structure that traps the remaining oil. Under these environments, restriction in the flow of the fuel occurs. Thus, good low temperature flow characteristics (pour point) of a fuel is essential to ensure smooth operation and to be suitable for various applications. A fuel is necessary to have good pour point, which is the temperature of the oil 3° C. above the point at which the oil will not move when tipped out of the horizontal. The pour point of all samples were analysed using standard method ASTM D97. The pour point should be below the operational temperature.

To improve the low temperature characteristics mentioned earlier, pour point depressants are normally employed. They act through surface adsorption on to the wax crystals. The resulting surface layer of the pour point depressant inhibits the growth of the wax and paraffin crystals. Thus, in the absence of long inter-locking crystals or swollen particles, fuel can move freely. However, these additives though blended into the fuel in small quantity, they are costly.

SUMMARY OF THE INVENTION

The present invention relates to a biofuel with improved cold temperature flow characteristics without additives (pour point depressant). More particularly but not exclusively, it relates to an improved biofuel as a substitute for petroleum diesel from palm oil, palm kernel oil, palm oil products and palm kernel oil products.

The present invention discloses the premium grade palm diesel composition and its good low temperature properties. Contrary to the palm oil methyl esters, the disclosed premium grade palm diesel (biodiesel) will be suitable to be used in cold climate countries.

The present invention also discloses the processes of producing the said low pour point palm diesel particularly but not exclusively via esterification of C18, C18:1 and C18:2 mixed fatty acids with methanol or ethanol;

fractional distillation of methyl or ethyl esters of palm oil, palm kernel oil, palm oil products and palm kernel oil products;

fractional distillation of methyl or ethyl esters of palm oil, palm kernel oil, palm oil products and palm kernel oil products, followed by crystallisation;

crystallisation of methyl or ethyl esters of palm oil, palm kernel oil, palm oil products and palm kernel oil products;

crystallisation of methyl or ethyl esters of palm oil, palm kernel oil, palm oil products and palm kernel oil products, followed by fractional distillation.

DETAILED DESCRIPTION OF THE INVENTION

The present invention discloses methyl oleate (more than 98% purity) and methyl linoleate (more than 98% purity) respectively or a mixture containing high proportion of methyl oleate and methyl linoleate (≧90%) as a premium grade palm diesel. This premium grade palm diesel can solve the pour point problem encountered when palm oil methyl esters (consisting of C16 (45%), C18 (5%), C18:1 (39%) and C18:2 (11%) are used in cold climate countries.

Methyl oleate, a fraction from palm oil methyl esters not only exhibits good fuel properties just like the palm oil methyl esters but also possesses low pour point of −18° C. Methyl linoleate exhibits pour point of −39° C. This pour point is very much lower compared to that of palm oil methyl esters (mixture of C16, C18, C18:1 and C18:2). Thus, it can be used in cold climate countries or during low operational temperatures. Similarly, it is found that a mixture containing high proportion of methyl oleate and methyl linoleate e.g. C14 (0.5%), C16 (4.9%), C18:1 (83.6%) and C18:2 (11.0%) also exhibits low pour point of −21° C. Whereas, a methyl esters mixture of C14 (0.6%), C16 (5.7%), C18 (2.0%), C18:1 (79.0%) and C18:2 (12.7%) exhibits pour point of −15° C. Methyl esters mixture of C14 (0.5%), C16 (6.3%), C18 (2.9%), C18:1 (74.6%) and C18:2 (15.7%) exhibits pour point of −12° C. While methyl esters mixture containing C14 (0.7%), C16 (6.7%), C18 (0.4%), C18:1 (75.5%) and C18:2 (16.7%) exhibits pour point of −9° C.

While the normal grade palm diesel would be the normal palm oil methyl or ethyl esters, (45% C16, 5% C18, 39% C18:1 and 11% C18:2), which exhibit pour point of +15° C. This grade is not suitable to be utilised in cold countries as it will solidify in cold countries. Whereas C18, C18:1 and C18:2 mixed methyl or ethyl esters that has a pour point of below −15° C. can be used in cold climate countries.

The said mixture of methyl or ethyl esters exhibiting low pour point can be produced, particularly but not exclusively via (1) esterification of C18, C18:1 and C18:2 mixed fatty acids with methanol and ethanol, or (2) fractional distillation of methyl or ethyl esters from palm oil, palm kernel oil, palm oil products and palm kernel oil products, or (3) fractional distillation of methyl or ethyl esters of palm oil, palm kernel oil, palm oil products and palm kernel oil products, followed by crystallisation, or (4) crystallisation of methyl or ethyl esters of palm oil, palm kernel oil, palm oil products and palm kernel oil products, or (5) crystallisation of methyl or ethyl esters of palm oil, palm kernel oil, palm oil products and palm kernel oil products, followed by fractional distillation.

All methyl and ethyl esters mentioned could be obtained through fractionation of methyl or ethyl esters of palm oil, palm kernel oil, palm oil products and palm kernel oil products or via esterification of the respective fatty acids and methanol or ethanol respectively. The acid-catalysed esterification of respective fatty acids (or mixed fatty acids cut) and methanol or ethanol can be carried out to yield the methyl or ethyl esters since fatty acids can be easily obtained from fat splitting of palm oil. The C16 methyl or ethyl esters and C18, C18:1 and C18:2 mixed methyl or ethyl esters can be obtained through fractionation of methyl or ethyl esters of palm oil, palm kernel oil, palm oil products and palm kernel oil products, either by fractional distillation or crystallisation or integrated fractional distillation and crystallisation under controlled pressure and temperature i.e. fractional distillation followed by crystallisation or crystallisation followed by fractional distillation. The C16 methyl esters can be sold for oleochemical uses. They can be used as feedstock for high quality white soap and with further mild hydrogenation process, they can also be used as feedstock for α-sulphonated methyl esters. The C18, C18:1 and C18:2 mixed methyl or ethyl esters fraction having pour point that meets the requirement (0° C. to −33° C.) can be used in temperate countries as biofuel.

Other than deriving low pour point palm diesel from palm oil methyl esters, the processes disclosed in this invention could be adapted to the production of low pour point palm diesel from palm kernel oil methyl or ethyl esters. Palm kernel oil methyl esters consists of C6 (0.3%), C8 (4.4%), C10 (3.6%), C12 (48.3%), C14 (15.6%), C16 (7.8%), C18 (2.0%), C18:1 (15.1%) and C18:2 (2.9%). Integrated processes of fractional distillation and crystallisation, i.e. fractional distillation followed by crystallisation or crystallisation followed by fractional distillation would lead to the production of low pour point palm diesel.

Crystallisation of methyl or ethyl esters of palm oil, palm kernel oil, palm oil products and palm kernel oil products can be done by dry fractionation;

solvent fractionation;

under gradual cooling and controlled conditions.

Saturated methyl or ethyl esters i.e. methyl or ethyl palmitate and methyl or ethyl stearate can be fractionated from the unsaturated methyl or ethyl esters i.e. methyl or ethyl oleate and methyl or ethyl linoleate via dry fractionation (crystallisation). Fine crystals formed when palm oil methyl or ethyl esters were subjected to gradual cooling and slow agitation. Upon subjecting the suspension of fine crystals to membrane filtration, C16 and C18 methyl or ethyl esters with purity of at least 80% can be produced. By subjecting the resultant fraction to second stage fractionation, the purity of the saturated methyl or ethyl esters can be further enhanced. The same approach can be used for the filtrate obtained from the first stage fractionation to produce the high compositional of methyl or ethyl oleate (C18:1 methyl esters) and methyl or ethyl linoleate (C18:2 methyl esters) with minimal methyl or ethyl palmitate (C16 methyl or ethyl esters) and methyl or ethyl stearate (C18 methyl or ethyl esters) in order to produce palm diesel with low pour point. The residue fractions obtained from several second stage crystallisation of filtrate rich in unsaturated methyl or ethyl esters are preferred to be combined and subjected to further crystallisation. While the filtrate fractions obtained from several second stage crystallisation of residue rich in saturated methyl or ethyl esters are also preferred to be combined and subjected to further crystallisation. Thus, in this manner, there will be no loss of the starting material (methyl or ethyl esters of palm oil, palm kernel oil, palm oil products and palm kernel oil products).

The present invention also discloses another route of fractionation, i.e. via solvent fractionation. Saturated methyl esters ie. methyl or ethyl palmitate and methyl or ethyl stearate can be efficiently fractionated from unsaturated methyl or ethyl esters ie. methyl or ethyl oleate and methyl or ethyl linoleate. Methanol, ethanol and isopropanol have been proven to be excellent choices of solvent for the crystallisation of saturated methyl or ethyl esters from the unsaturated methyl or ethyl esters. The typical composition of unsaturated methyl esters fraction obtained is 1-2% methyl myristate, 4-6% methyl palmitate, 0-1% methyl stearate, 70-72% methyl oleate, 20-22% methyl linoleate and 0-1% methyl arachidate. While the saturated methyl esters fraction consists of 0-0.4% methyl myristate, 86-89% methyl palmitate, 6-7% methyl stearate, 3-5% methyl oleate, 1-2% methyl linoleate and 0-2% of methyl arachidate.

One aspect of the present invention discloses the composition of methyl or ethyl esters (C8, C10, C12, C14, C16, C18, C18:1 and C18:2 methyl or ethyl esters) carbon chain length of and the respective pour point. The pour point depends very much on the percentage of methyl or ethyl esters of different chain length. It is found that a mixture containing high proportion of methyl oleate and methyl linoleate e.g. C14 (0.5%), C16 (4.9%), C18:1 (83.6%) and C18:2 (11.0%) also exhibits low pour point of −21° C. Whereas, a methyl esters mixture of C14 (0.6%), C16 (5.7%), C18 (2.0%), C18:1 (79.0%) and C18:2 (12.7%) exhibits pour point of −15° C. Methyl esters mixture of C14 (0.5%), C16 (6.3%), C18 (2.9%), C18:1 (74.6%) and C18:2 (15.7%) exhibits pour point of −12° C. While methyl esters mixture containing C14 (0.7%), C16 (6.7%), C18 (0.4%), C18:1 (75.5%) and C18:2 (16.7%) exhibits pour point of −9° C. Low pour point palm diesel can also be achieved if and only if the mixture of methyl or ethyl esters of palm oil, palm kernel oil, palm oil products and palm kernel oil products has (1) less than 10% of total saturated methyl or ethyl esters i.e. C14 methyl or ethyl ester, C16 methyl or ethyl ester and C18 methyl or ethyl ester (2) at least 90% C18:1 and C18:2 mixed methyl or ethyl ester.

Besides exhibiting low pour point, the C18, C18:1 and C18:2 mixed methyl or ethyl esters also exhibit other fuel properties (viscosity, flash point, sulfur content, gross heat of combustion, conradson carbon residue, specific gravity and boiling point) similar to those of petroleum diesel, thus indicating its suitability as a diesel substitute. The overall performance of the C18 mixed methyl esters is also being tested in stationery engines and field trials.

The following examples further illustrate the present invention.

EXAMPLE 1

The premium grade palm diesel has pour point ≦15° C., depending on its composition.

Mixture of methyl esters, namely methyl myristate (0.5%), methyl palmitate (4.9%), methyl oleate (83.6%) and methyl linoleate (11.0%) exhibit low pour point of −21° C. This methyl esters mixture was obtained via acid-catalysed direct esterification of technical grade of oleic acid (with purity ≈80%) with methanol.

Mixture of methyl esters synthesized with 0.6% methyl myristate, 5.7% of methyl palmitate, 2.0% methyl stearate, 79.0% methyl oleate and 12.7% methyl linoleate has a pour point of −15° C. Therefore, these mixtures of C18, C18:1 and C18:2 methyl esters can be utilised in temperate countries when the operational temperature dropped to below 15° C.

EXAMPLE 2

Mixtures of C18, C18:1 and C18:2 methyl esters can also be obtained through vacuum fractional distillation of palm oil methyl esters (consisting of C16 (45%), C18 (5%), C18:1 (39%) and C18:2 (11%). At pressure of 30 Pa, 90% methyl palmitate was fractionated out at 139° C. followed by mixtures of C18, C18:1 and C18:2 methyl esters at 154-156° C. This fraction of methyl esters exhibits pour point of below 0° C.

EXAMPLE 3

Another possible route to produce different grade of palm diesel is by using partial vacuum fractionation of palm oil methyl esters. Under pressure of 25 Pa and temperature ranging between 145° C. to 154° C., mixture of methyl esters consisting 6.0% methyl palmitate, 8.5% methyl stearate, 69.5% methyl oleate and 16.0% methyl linoleate was obtained. This fraction of methyl esters exhibits pour point of below 0° C.

EXAMPLE 4

Crystallisation of palm oil methyl esters was carried out using one part by weight of palm oil methyl esters in two parts by weight of methanol. Bulk of C16 methyl esters crystallised out from palm oil methyl esters when cooled down from 22° C. to −12° C. in two stages. The remaining unsaturated (C18:1 and C18:2) mixed methyl esters has a pour point of −33° C. This unsaturated mixed methyl esters consist 1.6% of methyl myristate, 5.0% methyl palmitate, 0.7% methyl stearate, 72.9% methyl oleate, 19.4% methyl linoleate and 0.4% methyl arachidate.

EXAMPLE 5

Crystallisation of palm oil methyl esters was carried out using one part by weight of palm oil methyl esters in two parts by weight of methanol. The mixture was cooled to +5° C. in 30 minutes. The mixture was filtered using suction filtration to collect both the residue and filtrate. The filtrate was then subjected to second stage crystallisation, where it was cooled to −11° C. in 2.5 hours. The filtrate after this stage consists high percentage of unsaturated methyl esters, e.g. 70-72% C18:1 methyl esters and 20-22% C18:2 methyl esters. The filtrate exhibits pour point of −12° C. The residue collected from the first stage of crystallisation was washed with some cold methanol (+5° C.) in order to get high percentage of saturated methyl esters.

EXAMPLE 6

Solvent crystallisation of distilled palm oil methyl esters using methanol as solvent can also be carried out by one step chilling. The mixture was cooled to −9° C. in 2 hours. After suction filtration, the filtrate collected contains 68-69% C18:1 methyl ester and 18-19% C18:2 methyl ester; and exhibits pour point of −9° C.

EXAMPLE 7

Crystallisation of palm oil methyl esters was carried out using one part by weight of palm oil methyl esters in two parts by weight of ethanol. In the first stage of crystallisation, the mixture was cooled to +3° C. in 30 minutes. While in the second stage of crystallisation, the filtrate was cooled to −9° C. in 2.5 hours. After filtration, filtrate with high percentage of unsaturated methyl esters, e.g. 63-64% C18:1 methyl ester and 15-16% C18:2 methyl esters was obtained and the pour point is 0° C.

EXAMPLE 8

Crystallisation of palm oil methyl esters was carried out using one part by weight of palm oil methyl esters in three parts by weight of methanol. In the first stage of crytallisation, the mixture was cooled to +2° C. in 1 hour. While in the second crystallisation, the filtrate was then cooled to −12° C. for 2.5 hours. After filtration to remove the residue, high percentage of unsaturated methyl esters, e.g. 71-72% C18:1 methyl ester and 18-19% C18:2 methyl esters. This mixture exhibits pour point of −12° C. Meanwhile, the residue collected from the first and second stage crystallisation was washed with cold methanol in order to get high purity of saturated methyl esters, e.g. 91-92% C16 methyl ester and 6-7% C18:0 methyl esters.

EXAMPLE 9

Crystallisation was carried out for the fractions obtained from partial fractional distillation. A fraction consists of 3.4% C16 methyl esters, 8.8% C18 methyl esters, 71.6% C18:1 methyl esters and 16.2% C18:2 methyl esters was cooled down from +26° C. to 0° C. in 30 minutes crystallisation in a water bath of −5° C. One part by weight of methanol was used for one part by weight of the mentioned fraction was used. The residue consists of 5.6% C16 methyl esters, 84.0% C18 methyl esters, 5.8% C18:1 methyl esters, 1.2% C18:2 methyl esters and 3.4% C20 methyl esters.

EXAMPLE 10

Crystallisation of a fraction consisting 0.3% C12 methyl esters, 2.2% C14 methyl esters, 64.5% C16 methyl esters, 2.1% C18 methyl esters, 24.7% C18:1 methyl esters and 6.2% C18:2 methyl esters was carried out in a water bath at −5° C., cooling from +26° C. to +5° C. in 20 minutes. This process produced residue which consists 0.9% C14 methyl esters, 91.5% C16 methyl esters, 1.6% C18 methyl esters, 5.1% C18:1 methyl esters and 0.9% C18:2 methyl esters. One part by weight of methanol was used for one part of weight of fraction.

EXAMPLE 11

Crystallisation of a fraction consisting 0.3% C12 methyl esters, 2.2% C14 methyl esters, 64.5% C16 methyl esters, 2.1% C18 methyl esters, 24.7% C18:1 methyl esters and 6.2% C18:2 methyl esters was carried out in a water bath at −5° C., cooling from +26° C. to +5° C. in 3 minutes. This process produced residue with composition of 0.9% C14 methyl esters, 91.4% C16 methyl esters, 2.1% C18 methyl esters, 4.7% C18:1 methyl esters and 0.9% C18:2 methyl esters. Two parts by weight of methanol was used for one part by weight of fraction. Meanwhile, the filtrate consists of 10.7% C16 methyl esters, 4.5% C18 methyl esters, 68.6% C18:1 methyl esters, 15.6% C18:2 methyl esters and 0.6% C20 methyl esters; and exhibits pour point of −6° C.

EXAMPLE 12

Dry crystallisation of a fraction consisting 0.3% C12 methyl esters, 2.2% C14 methyl esters, 64.5% C16 methyl esters, 2.1% C18 methyl esters, 24.7% C18:1 methyl esters and 6.2% C18:2 methyl esters was carried out in a water bath at −5° C., cooling from +25° C. to +10° C. in 5 minutes. This process produced residue with composition of 1.5% C14 methyl esters, 83.0% C16 methyl esters, 2.0% C18 methyl esters, 11.4% C18:1 methyl esters and 2.1% C18:2 methyl esters. Meanwhile, the filtrate consists of 10.5% C16 methyl esters, 2.4% C18 methyl esters, 70.2% C18:1 methyl esters, 16.1% C18:2 methyl esters and 0.8% C20 methyl esters; and exhibits pour point of −6° C.

EXAMPLE 13

Dry fractionation of palm oil methyl esters consists of C14 (1.0%), C16 (45.0%), C18 (4.1%), C18:1 (39.9%), C18:2 (9.7%) and C20 (0.3%) was carried out under gradual cooling from +40° C. to +8° C. in 15 hours and held at that temperature for 3 hours. Upon filtration of the crystals suspension by membrane filter press, the resultant residue consists of C14 (0.8%), C16 (86.0%), C18 (1.8%), C18:1 (8.8%) and C18:2 (2.6%), i.e. 88.6% saturated methyl esters and 11.4% unsaturated methyl esters. While the filtrate consists of C12 (0.7%), C14 (2.0%), C16 (25.0%), C18 (2.4%), C18:1 (53.6%) and C18:2 (15.9%) and C20 (0.4%), i.e. 30.5% saturated methyl esters and 69.5% unsaturated methyl esters; and exhibits pour point of 6° C.

EXAMPLE 14

Dry fractionation of palm oil methyl esters consists of C14 (1.0%), C16 (45.0%), C18 (4.1%), C18:1 (39.9%), C18:2 (9.7%) and C20 (0.3%) was carried out under gradual cooling from +40° C. to +9° C. in 6 hours and held at that temperature for 12 hours. Upon filtration of the crystals suspension by membrane filter press, the resultant residue consists of C14 (0.9%), C16 (79.7%), C18 (1.9%), C18:1 (13.5%) and C18:2 (4.0%), i.e. 82.5% saturated methyl esters and 17.5% unsaturated methyl esters. While the filtrate consists of C12 (0.7%), C14 (2.1%), C16 (25.1%), C18 (2.4%), C18:1 (53.2%) and C18:2 (16.0%) and C20 (0.5%), i.e. 30.8% saturated methyl esters and 69.2% unsaturated methyl esters; and exhibits pour point of 6° C.

EXAMPLE 15

Second stage of dry crystallisation on the residue or the saturated methyl esters was carried out using the residue obtained from a process as described in Example 14 to improve the purity. The filtrate which consists of C14 (0.9%), C16 (79.7%), C18 (1.9%), C18:1 (13.5%) and C18:2 (4.0%), i.e. 82.5% saturated methyl esters and 17.5% unsaturated methyl esters was subjected to gradual cooling from +40° C. to +24° C. in 4.5 hours and held at that temperature for 2.5 hours. Upon filtration of the crystal suspension by membrane filter press, the resultant residue consists of C14 (0.3%), C16 (95.2%), C18 (1.0%), C18:1 (2.7%) and C18:2 (0.8%), i.e. 96.5% saturated methyl esters and 3.5% unsaturated methyl esters. The residue which was high in saturated methyl esters (96.5%) was further subjected to mild hydrogenation process (pressure less than 50 MPa and temperature less than 300° C. using conventional catalyst such as Nickel). The resultant product has an iodine value less than 0.5 and can be used as feedstock for α-sulphonated methyl esters. While the filtrate consists of C12 (0.3%), C14 (2.1%), C16 (68.6%), C18 (2.4%), C18:1 (20.6%) and C18:2 (6.0%), i.e. 73.4% saturated methyl esters and 26.6% unsaturated methyl esters.

EXAMPLE 16

Dry fractionation of palm oil methyl esters consists of C14 (1.0%), C16 (45.0%), C18 (4.1%), C18:1 (39.9%), C18:2 (9.7%) and C20 (0.3%) was carried out under gradual cooling from +40° C. to +12° C. in 15 hours and held at that temperature for 3 hours. Upon filtration of the crystals suspension by membrane filter press, the resultant residue consists of C14 (0.7%), C16 (87.9%), C18 (1.6%), C18:1 (7.7%) and C18:2 (2.1%), i.e. 90.2% saturated methyl esters and 9.8% unsaturated methyl esters. While the filtrate consists of C12 (0.7%), C14 (1.9%), C16 (32.1%), C18 (2.4%), C18:1 (48.3%) and C18:2 (14.3%) and C20 (0.3%), i.e. 37.4% saturated methyl esters and 62.6% unsaturated methyl esters; and exhibits pour point between 9 to 12° C. The filtrate was subjected to a second stage dry crystallisation.

EXAMPLE 17

Second stage of dry crystallisation on the filtrate or the unsaturated methyl esters was carried out using the filtrate obtained from a process as described in Example 16 to improve the purity. The filtrate which consists of C12 (0.7%), C14 (1.9%), C16 (32.1%), C18 (2.4%), C18:1 (48.3%) and C18:2 (14.3%) and C20 (0.3%), i.e. 37.4% saturated methyl esters and 62.6% unsaturated methyl esters was subjected to gradual cooling from +40° C. to +2° C. in 13 hours and held at that temperature for 6 hours. Upon filtration of the crystals suspension by membrane filter press, the resultant residue consists of C12 (1.0%), C14 (1.6%), C16 (54.0%), C18 (2.8%), C18:1 (31.3%) and C18:2 (9.3%), i.e. 59.4% saturated methyl esters and 40.6% unsaturated methyl esters. While the filtrate consists of C12 (0.8%), C14 (2.2%), C16 (17.8%), C18 (2.3%), C18:1 (58.9%) and C18:2 (17.7%) and C20 (0.3%), i.e. 23.4% saturated methyl esters and 76.6% unsaturated methyl esters; and exhibits pour point of 3° C.

EXAMPLE 18

One mole of technical grade of oleic acid (with fatty acid composition of 0.5% C14, 5.5% C16, 80.2% C18:1 and 13.8% of C18:2) was esterified with six moles of methanol at 160° C. A 0.5 weight percent of concentrated sulphuric acid was used as catalyst. After 4.5 hours of reaction, the crude product was water washed until the decanted aqueous layer was neutral. The dried product was subjected to second stage of esterification (re-esterification). The esterification steps were similar to the first stage esterification, except 0.3 weight percent of catalyst was used. The resultant methyl esters from the first and second stage esterification exhibit pour point of −15° C. and −21° C. respectively.

EXAMPLE 19

A fraction obtained from crystallisation with composition of C14 (0.3%), C16 (95.2%), C18 (1.0%), C18:1 (2.7%) and C18:2 (0.8%), i.e. 96.5% saturated methyl esters and 3.5% unsaturated methyl esters was subjected to further fractional distillation and/or hydrogenation process (pressure less than 50 MPa and temperature less than 300° C., using conventional catalyst such as Nickel). This integrated process managed to produce C16 methyl esters and/or C16 and C18 mixed methyl esters with purity more than 97% and iodine value less than 0.5. The resultant product is suitable to be used as feedstocks for α-sulphonated methyl esters.

EXAMPLE 20

Second stage of dry crystallisation on the filtrate or the unsaturated methyl esters was carried out using the filtrate obtained from a process as described in Example 16 to improve the purity. The filtrate which consists of C12 (0.7%), C14 (1.9%), C16 (32.1%), C18 (2.4%), C18:1 (48.3%) and C18:2 (14.3%) and C20 (0.3%), i.e. 37.4% saturated methyl esters and 62.6% unsaturated methyl esters was subjected to gradual cooling from +40° C. to −4° C. in 16 hours and held at that temperature for 6 hours. Upon filtration of the crystals suspension by membrane filter press, the resultant residue consists of C14 (1.5%), C16 (46.5%), C18 (3.9%), C18:1 (37.5%) and C18:2 (10.6%), i.e. 51.9% saturated methyl esters and 48.1% unsaturated methyl esters. While the filtrate consists of C12 (0.8%), C14 (2.0%), C16 (8.5%), C18 (1.6%), C18:1 (67.9%) and (19.2%), i.e. 12.9% saturated methyl esters and 87.1% unsaturated methyl esters; and exhibits pour point of −9° C.

EXAMPLE 21

Second stage of dry crystallisation on the filtrate or the unsaturated methyl esters was carried out using the filtrate obtained from a process as described in Example 16 to improve the purity. The filtrate which consists of C12 (0.7%), C14 (1.9%), C16 (32.1%), C18 (2.4%), C18:1 (48.3%) and C18:2 (14.3%) and C20 (0.3%), i.e. 37.4% saturated methyl esters and 62.6% unsaturated methyl esters was subjected to gradual cooling from +40° C. to −10° C. in 16 hours and held at that temperature for 6 hours. Upon filtration of the crystals suspension by membrane filter press, the filtrate consists of more than 90.0% unsaturated methyl esters; and exhibits pour point of −24° C.

EXAMPLE 22

A methyl esters fraction obtained from crystallization and consists of methyl esters of C12 (0.7%), C14 (2.1%), C16 (25.1%), C18 (2.4%), C18:1 (53.2%) and C18:2 (16.0%) and C20 (0.5%) was subjected to fractional distillation. At pressure of 20-50 Pa and temperature below 145° C., C16 methyl esters was distilled over and the remaining methyl esters consists of more than 90% C18:1 and C18:2 methyl esters exhibits pour point of −21° C.

EXAMPLE 23

The C18, C18:1 and C18:2 mixed esters not only has low pour point but also exhibit good fuel properties that are comparable to palm oil methyl esters. TABLE 1 the tabulated fatty acid composition of the mixed methyl esters and its respective fuel properties are tabulated in the TABLE 2.

TABLE 1

Fatty Acid Composition (as % weight methyl esters) of C18, C18:1 and C18:2 Mixed Methyl Esters.

| Methyl Esters | Fatty Acid Composition (as % weight methyl esters) |
|---|---|
| Methyl Palmitate (C16) | 4.2 |
| Methyl Stearate (C18) | 0.4 |
| Methyl Oleate (C18:1) | 81.6 |
| Methyl Linoleate (C18:2) | 13.8 |

TABLE 2

Fuel Properties of C18, C18:1 and C18:2 Methyl Esters, Palm Diesel and Malaysian Diesel

| Test | Palm Diesel | Methyl Esters (C18, C18:1 & C18:2 mixture) | Malaysian Diesel* |
|---|---|---|---|
| Specific Gravity ASTM D1290 | 0.8700 @ 74.5° F. | 0.8803 @ 60° F. | 0.8330 @ 60° F. |
| Sulfur Content (% wt) IP242 | 0.04 | 0.04 | 0.10 |
| Viscosity @ 40° C. (cSt) ASTM D445 | 4.5 | 4.5 | 4.0 |
| Pour Point (° C.) ASTM D97 | 16.0 | −15.0 | 15.0 |
| Gross Heat of Combustion (kJ/kg) ASTM D2332 | 40,335 | 39,160 | 45,800 |
| Flash Point (° C.) ASTM D93 | 174 | 153.0 | 98 |
| Conradson Carbon Residue (% wt) ASTM D198 | 0.02 | 0.1 | 0.14 |
| Distillation (° C.) Initial Boiling Point ASTM D86 | 324.0 | 282.2 | 228 |

*sample obtained from PETRONAS petrol kiosk

The invention claimed is:

1. A process to synthesize a biodiesel for use in cold climate countries from palm oil, palm kernel oil and/or products thereof comprising:

subjecting methyl or ethyl esters or mixtures thereof from palm oil, palm kernel oil and/or products thereof to at least one stage of solvent crystallization wherein the solvent used is alcohol and the methyl or ethyl esters or mixtures thereof are cooled to a crystallization temperature ranging from 5° C. to −12° C. to obtain a residue portion and a filtrate portion, wherein the filtrate portion is the biodiesel.

2. The process as claimed in claim 1, wherein the solvent used is methanol.

3. The process as claimed in claim 2, wherein the ratio of methanol to methyl or ethyl esters or mixtures thereof is ranging from 1:1 to 3:1.

4. The process according to claim 1, wherein said biodiesel has a pour point of −33° C.

5. The process according to claim 1, wherein said biodiesel comprises a mixture of methyl and ethyl esters.

6. The process according to claim 1, wherein the methyl or ethyl esters or mixtures thereof are cooled to a crystallization temperature ranging from −9° C. to −12° C.

7. The process according to claim 3, wherein methyl or ethyl esters or mixtures thereof have (1) less than 10% of total saturated methyl or ethyl esters and (2) at least 90% C18:1 and C18:2 mixed methyl or ethyl ester.

* * * * *